US012024977B2

(12) United States Patent
Webber et al.

(10) Patent No.: US 12,024,977 B2
(45) Date of Patent: Jul. 2, 2024

(54) STAGE COLLAR AND RELATED METHODS FOR STAGE CEMENTING OPERATIONS

(71) Applicant: FORUM US, INC., Houston, TX (US)

(72) Inventors: Andrew Webber, Hockley, TX (US); Jeffery Morrison, Missouri City, TX (US)

(73) Assignee: FORUM US, INC., Houston, TX (US)

( * ) Notice: Subject to any disclaimer, the term of this patent is extended or adjusted under 35 U.S.C. 154(b) by 49 days.

(21) Appl. No.: 17/987,367

(22) Filed: Nov. 15, 2022

(65) Prior Publication Data

US 2023/0151712 A1 May 18, 2023

Related U.S. Application Data

(60) Provisional application No. 63/280,462, filed on Nov. 17, 2021.

(51) Int. Cl.
*E21B 33/16* (2006.01)
*E21B 33/14* (2006.01)

(52) U.S. Cl.
CPC ..... *E21B 33/165* (2020.05); *E21B 33/146* (2013.01)

(58) Field of Classification Search
CPC ..... E21B 33/146; E21B 33/16; E21B 33/165
See application file for complete search history.

(56) References Cited

U.S. PATENT DOCUMENTS 3,811,500 A 5/1974 Morrisett et al.
3,948,322 A * 4/1976 Baker ..... E21B 33/127 166/187
4,042,014 A * 8/1977 Scott ..... E21B 33/16 166/154
4,674,569 A 6/1987 Revils et al.
4,880,058 A * 11/1989 Lindsey ..... E21B 33/146 166/291
5,038,862 A 8/1991 Giroux et al.
(Continued)

FOREIGN PATENT DOCUMENTS

AU 2012217607 B2 11/2015
GB 2526208 A 11/2015
(Continued)

OTHER PUBLICATIONS

International Search Report dated Feb. 9, 2023 for International Application No. PCT/US2022/079930.

*Primary Examiner* — Shane Bomar
(74) *Attorney, Agent, or Firm* — Patterson + Sheridan, LLP

(57) ABSTRACT

Aspects of the disclosure relate to stage collars and related methods of operation thereof for stage cementing operations. In one implementation, a stage collar for stage cementing operations includes a barrel, and an activation sleeve disposed at least partially in the barrel. The activation sleeve includes first fluid openings. The stage collar includes an activation ring that includes an activation seat. The stage collar includes a first set of shear fasteners coupling the activation ring to the activation sleeve, and a second set of shear fasteners coupling the activation sleeve to the barrel. The stage collar includes a setting piston, and a closing sleeve disposed at least partially in the barrel. The closing sleeve includes second fluid openings. The stage collar includes a third set of shear fasteners coupling the closing sleeve to the barrel.

22 Claims, 14 Drawing Sheets

FIG. 3

(56) References Cited

U.S. PATENT DOCUMENTS

| | | | | |
|---|---|---|---|---|
| 5,279,370 | A | 1/1994 | Brandell et al. | |
| 5,299,640 | A | 4/1994 | Streich et al. | |
| 5,348,089 | A | 9/1994 | Brandell et al. | |
| 8,997,882 | B2 | 4/2015 | Turley et al. | |
| 9,816,351 | B2 | 11/2017 | Lirette et al. | |
| 10,273,781 | B2 | 4/2019 | Themig et al. | |
| 11,125,048 | B1 * | 9/2021 | Giroux | E21B 33/146 |
| 2002/0166665 | A1 * | 11/2002 | Vincent | E21B 33/14 166/291 |
| 2006/0169466 | A1 * | 8/2006 | Stokley | E21B 33/127 166/387 |
| 2010/0051276 | A1 | 3/2010 | Rogers et al. | |
| 2013/0233570 | A1 * | 9/2013 | Acosta | E21B 34/14 166/383 |
| 2014/0034310 | A1 * | 2/2014 | Andersen | E21B 23/08 166/281 |
| 2015/0060064 | A1 * | 3/2015 | Lafferty | E21B 43/267 166/185 |
| 2015/0330181 | A1 * | 11/2015 | Budde | E21B 34/14 166/185 |
| 2015/0345252 | A1 | 12/2015 | McNabb et al. | |
| 2017/0211349 | A1 | 7/2017 | Themig et al. | |
| 2021/0010345 | A1 | 1/2021 | Acosta et al. | |
| 2022/0074276 | A1 * | 3/2022 | Webber | E21B 34/142 |
| 2022/0372843 | A1 * | 11/2022 | Anderson | E21B 33/134 |
| 2024/0035356 | A1 * | 2/2024 | Webber | E21B 23/06 |

FOREIGN PATENT DOCUMENTS

| | | | |
|---|---|---|---|
| WO | 2021097017 | A1 | 5/2021 |
| WO | 2021183379 | A1 | 9/2021 |

* cited by examiner

STAGE COLLAR AND RELATED METHODS FOR STAGE CEMENTING OPERATIONS

CROSS-REFERENCE TO RELATED APPLICATION

This application claims benefit of U.S. provisional patent application Ser. No. 63/280,462, filed Nov. 17, 2021, which is herein incorporated by reference in its entirety.

BACKGROUND

Field

Aspects of the disclosure relate to stage collars and related methods of operation thereof for stage cementing operations.

Description of the Related Art

Stage collars for stage cementing operations can be limited in operations. For example, stage collars can have loose gas seal ratings and can be affected by pressures, such as pressures in casing annuluses. As another example, stage collars can fail to properly set and/or can prematurely set in wellbores, such as in reaction to wellbore pressure variations. Stage collars can be complex and can involve drilling out of numerous components.

Therefore, there is a need for new and improved stage collars that facilitate reliable operation, reduced operational delays, and reduced costs.

SUMMARY

Aspects of the disclosure relate to stage collars and related methods of operation thereof for stage cementing operations.

In one implementation, a stage collar for stage cementing operations includes a barrel, and an activation sleeve disposed at least partially in the barrel. The activation sleeve includes first fluid openings. The stage collar includes an activation ring that includes an activation seat. The stage collar includes a first set of shear fasteners coupling the activation ring to the activation sleeve, and a second set of shear fasteners coupling the activation sleeve to the barrel. The stage collar includes a setting piston, and a closing sleeve disposed at least partially in the barrel. The closing sleeve includes second fluid openings. The stage collar includes a third set of shear fasteners coupling the closing sleeve to the barrel.

In one implementation, a method of operating a stage collar includes running the stage collar in a wellbore in a run configuration. The method includes positioning a first plug member against an activation seat of an activation ring. The activation ring is coupled to an activation sleeve using a first set of shear fasteners. The activation sleeve is disposed at least partially in a barrel and is coupled to the barrel using a second set of shear fasteners. The method includes pressurizing the first plug member at a first pressure to shear the first set of shear fasteners and translate the activation ring to abut the activation ring against an activation end ring coupled to the activation sleeve. The translation of the activation ring includes opening first fluid openings formed in the activation sleeve. The method includes pressurizing a setting piston at a second pressure through the first fluid openings, and pressurizing the first plug member at a third pressure to shear the second set of shear fasteners and translate the activation sleeve to an open position. The translation of the activation sleeve to the open position includes opening second fluid openings formed in a closing sleeve disposed at least partially in the barrel and coupled to the barrel using a third set of shear fasteners. The method includes pumping a cementing fluid through the second fluid openings and into a casing annulus, and positioning a second plug member against a closing seat of a closing end ring coupled to the closing sleeve. The method includes pressurizing the plug to shear the third set of fasteners and translate the closing sleeve to a closed position. The translation of the closing sleeve to the closed position includes closing the second fluid openings formed in the closing sleeve.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figures 1, 3:
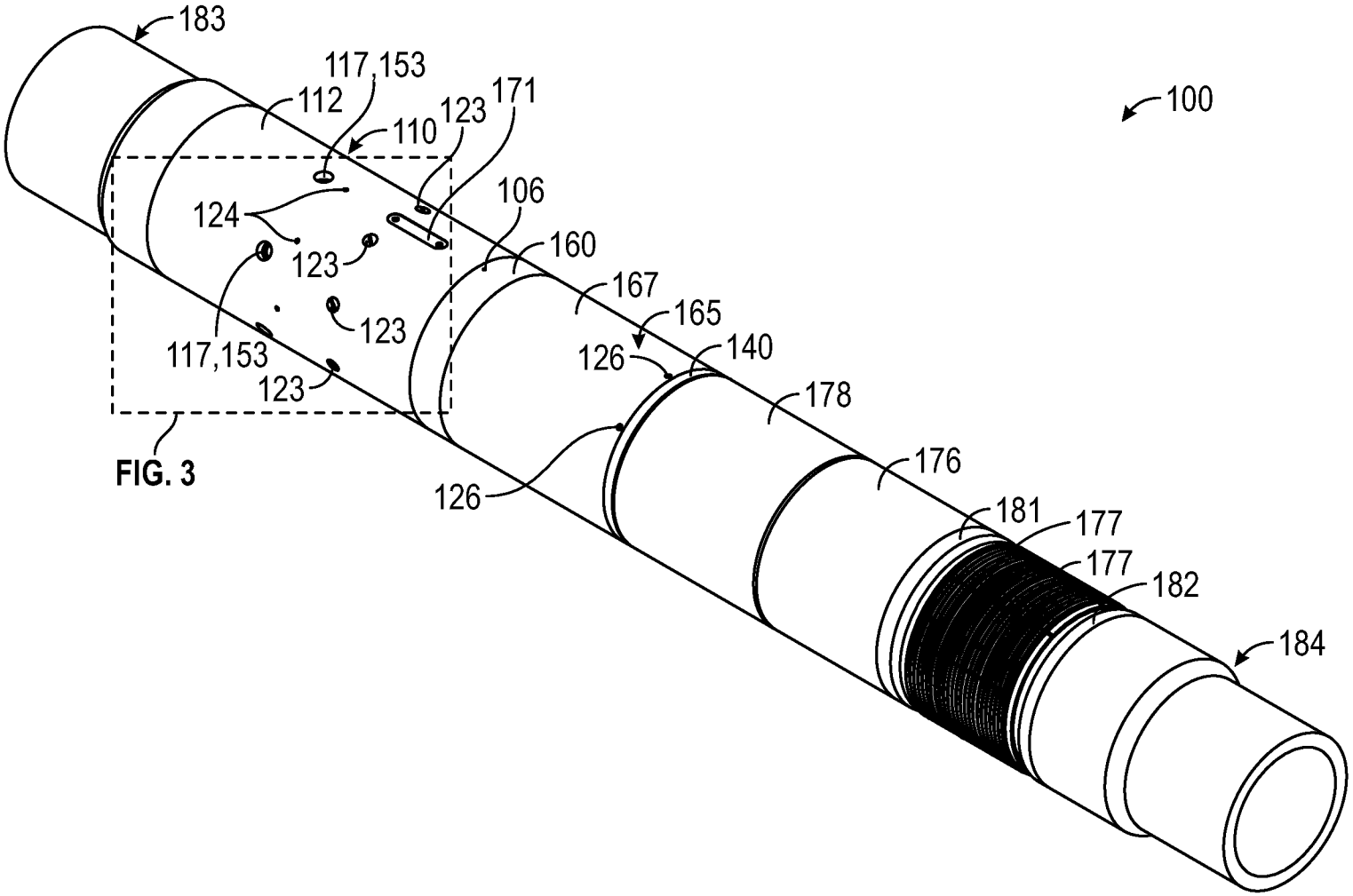
FIG. 1 is a schematic isometric view of a stage collar for cementing operations in a run configuration, according to one implementation.
FIG. 3 is an enlarged view of the schematic isometric view of the stage collar shown in FIG. 1, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the disclosure relate to stage collars and related methods of operation thereof for stage cementing operations.

The disclosure contemplates that terms such as "couples," "coupling," "couple," and "coupled" may include but are not limited to welding, interference fitting, and/or fastening such as by using bolts, threaded connections, pins, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Figure 2:
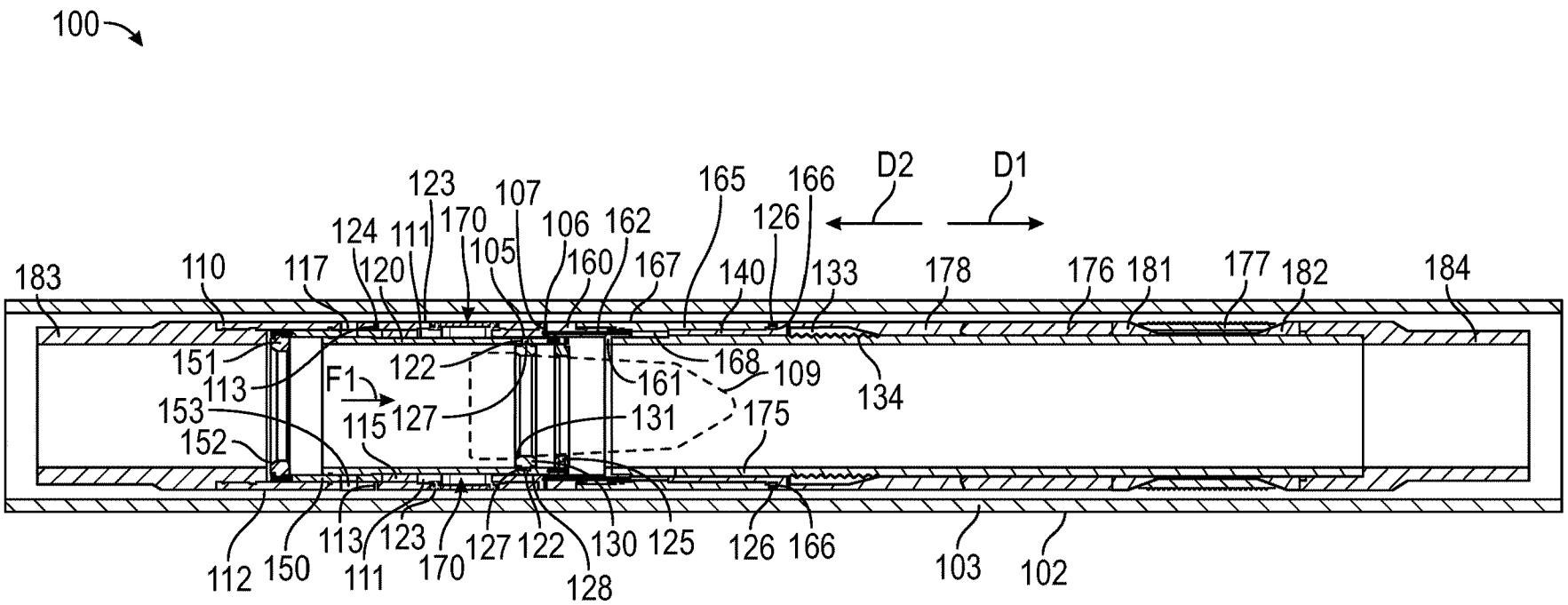
FIG. 2 is a schematic cross-sectional view of the stage collar shown in FIG. 1, according to one implementation.
Figure 3:
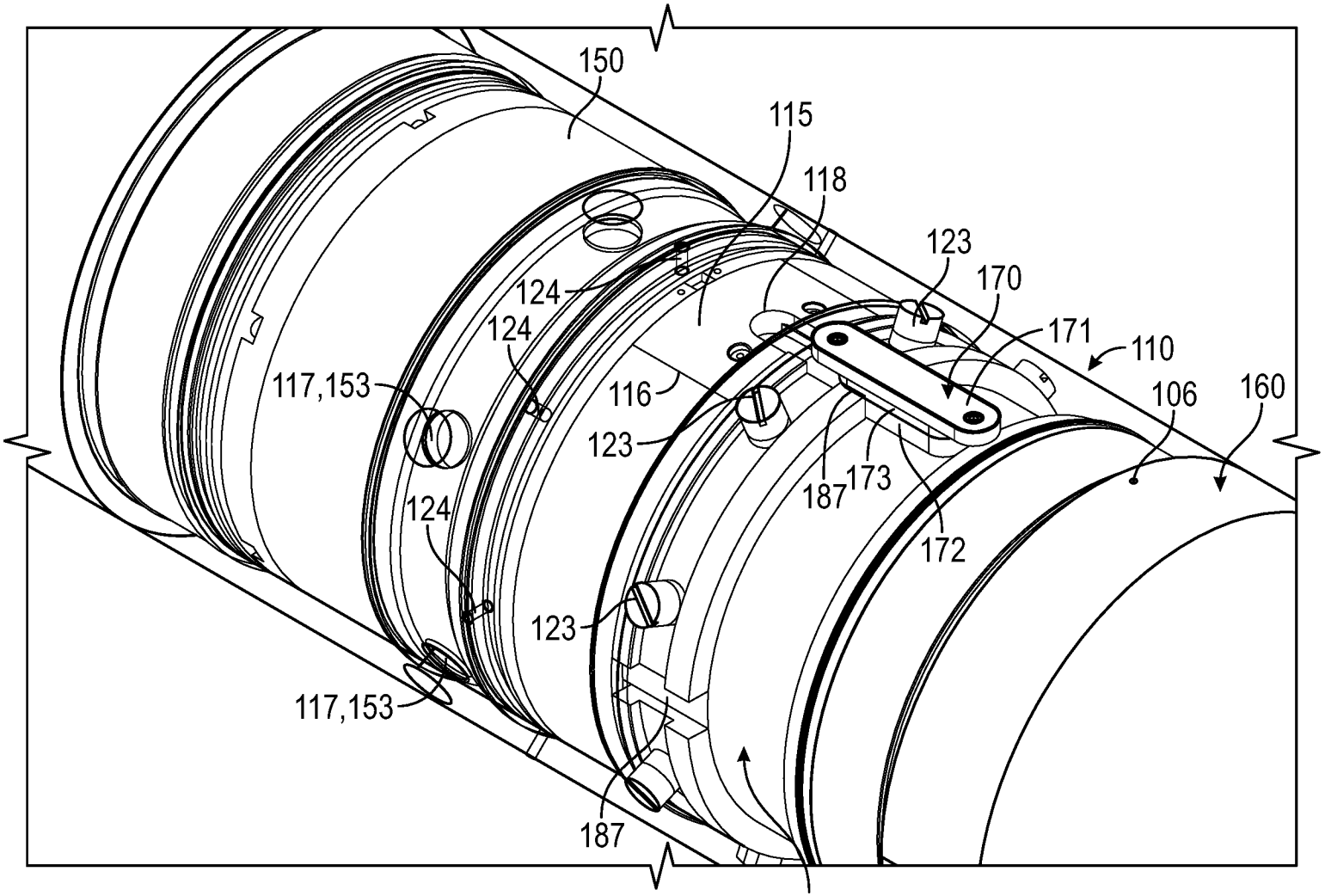

FIG. 1 is a schematic isometric view of a stage collar 100 for cementing operations in a run configuration, according to one implementation. FIG. 2 is a schematic cross-sectional view of the stage collar 100 shown in FIG. 1, according to one implementation. FIG. 3 is an enlarged view of the schematic isometric view of the stage collar 100 shown in FIG. 1, according to one implementation. A barrel 110 of the stage collar 100 is shown as transparent (e.g., see-through) in FIG. 3.

The stage collar 100 is lowered into a wellbore 102 to a desired location. Fluid can flow freely through the inner bore of the stage collar 100 when lowered into the wellbore 102. A plug member, such as a dart or cone, referred to herein as a cone 109 (shown in dashed lines) can be pumped down into the stage collar 100 after the stage collar 100 is located at the desired location within the wellbore 102.

The stage collar 100 includes a barrel 110 and an activation sleeve 120 disposed at least partially in the barrel 110. The activation sleeve 120 includes first fluid openings 121. The stage collar 100 includes an activation ring 130 that includes an activation seat 131. The stage collar 100 includes a first set of shear fasteners 122 coupling the activation ring 130 to the activation sleeve 120. The stage collar 100 includes a second set of shear fasteners 123 coupling the activation sleeve 120 to the barrel 110.

The stage collar 100 includes a setting piston 140 and a closing sleeve 150 disposed at least partially in the barrel 110. The closing sleeve 150 includes second fluid openings 153. The stage collar 100 includes a third set of shear fasteners 124 coupling the closing sleeve 150 to the barrel 110. The stage collar 100 includes an activation end ring 125 coupled to the activation sleeve 120, and a closing end ring 151 coupled to the closing sleeve 150. The closing end ring 151 includes a closing seat 152. The stage collar 100 includes a first chamber housing 160 disposed at least partially about the activation sleeve 120 and coupled to the barrel 110, and a second chamber housing 165 interfacing with and coupled to the first chamber housing 160. The first chamber housing 160 includes a housing seat 161 extending inwardly. The second chamber housing 165 is coupled to the setting piston 140 using a fourth set of shear fasteners 126.

The first set of shear fasteners 122 are disposed in a first set of fastener openings 127 extending into an outer surface 128 of the activation sleeve 120. The second set of shear fasteners 123 are disposed in a second set of fastener openings 111 extending into an outer surface 112 of the barrel 110. The third set of shear fasteners 124 are disposed in a third set of fastener openings 113 extending into the outer surface 112 of the barrel 110. The fourth set of shear fasteners 126 are disposed in a fourth set of fastener openings 166 extending into an outer surface 167 of the second chamber housing 165. Each of the shear fasteners 123, 124, 126 is externally adjustable from an outer side of the stage collar 100. In one embodiment, which can be combined with other embodiments, each of the shear fasteners 122, 123, 124, 126 is a shear screw or a shear pin. The shear fasteners 122, 123, 124, 126 can be adjusted by turning and/or replacing the respective shear fasteners 122, 123, 124, 126.

Each of the shear fasteners 122, 123, 124, 126 is adjustable to adjust the respective pressures (e.g., the shear strength) at which the shear fasteners 122, 123, 124, 126 shear. In one embodiment, which can be combined with other embodiments, a second shear strength of the second set of shear fasteners 123 is higher than a first shear strength of the first set of shear fasteners 122, a third shear strength of the third set of shear fasteners 124 is higher than the second shear strength of the second set of shear fasteners 123, and a fourth shear strength of the fourth set of shear fasteners 126 is higher than the first shear strength of the first set of shear fasteners 122.

A first flow chamber 162 is formed in the first chamber housing 160, and a second flow chamber 168 is formed in the second chamber housing 165. A flow gap 105 is between the activation sleeve 120 and the first chamber housing 160. A bypass line 106 is formed in the first chamber housing 160 and in fluid communication with the first flow chamber 162, and a check valve 107 is positioned along the bypass line 106.

The stage collar 100 includes a plurality of arcuate plates 115 (two are shown in FIG. 2) coupled to the activation sleeve 120. The arcuate plates 115 are each disposed at least partially in a respective recess 116 formed in the activation sleeve 120. The stage collar 100 includes a plurality of keys 170 (two are shown in FIG. 2). Each key 170 includes a key plate 171 coupled to the barrel 110 and a key post 172 extending relative to the key plate 171 and into a respective slot 173 formed in the barrel 110 and into a respective slot 187 formed in the activation sleeve 120. Each arcuate plate 115 includes a plate slot 118 aligned with the respective slot 187 of the activation sleeve 120.

The stage collar 100 includes a mandrel 175, a packer 176 disposed outwardly of the mandrel 175, and a plurality of slips 177 disposed outwardly of the mandrel 175. The stage collar 100 includes a gauge ring 178 disposed about the mandrel 175 and an inner wedge ring 133 disposed between the gauge ring 178 and the mandrel 175. The second chamber housing 165 is coupled to the mandrel 175, and the barrel 110 is coupled to the first chamber housing 160. The stage collar 100 includes a first wedge ring 181 and a second wedge ring 182. The plurality of slips 177 are disposed between the first wedge ring 181 and the second wedge ring 182. The packer 176 is disposed between the gauge ring 178 and the first wedge ring 181. A first sub 183 is coupled to the barrel 110 and a second sub 184 is coupled to the mandrel 175. The first sub 183 is a box sub and the second sub 184 is a pin sub.

The stage collar 100 is ran downhole in the wellbore 102, within a casing 103 of the wellbore 102. The cone 109 (shown in dashed lines in FIG. 2) is pumped down and lands against the activation seat 131 of the activation ring 130. The cone 109 is pressurized at a first pressure using an operations fluid F1 to shear the first set of shear fasteners 122.

Figure 4:
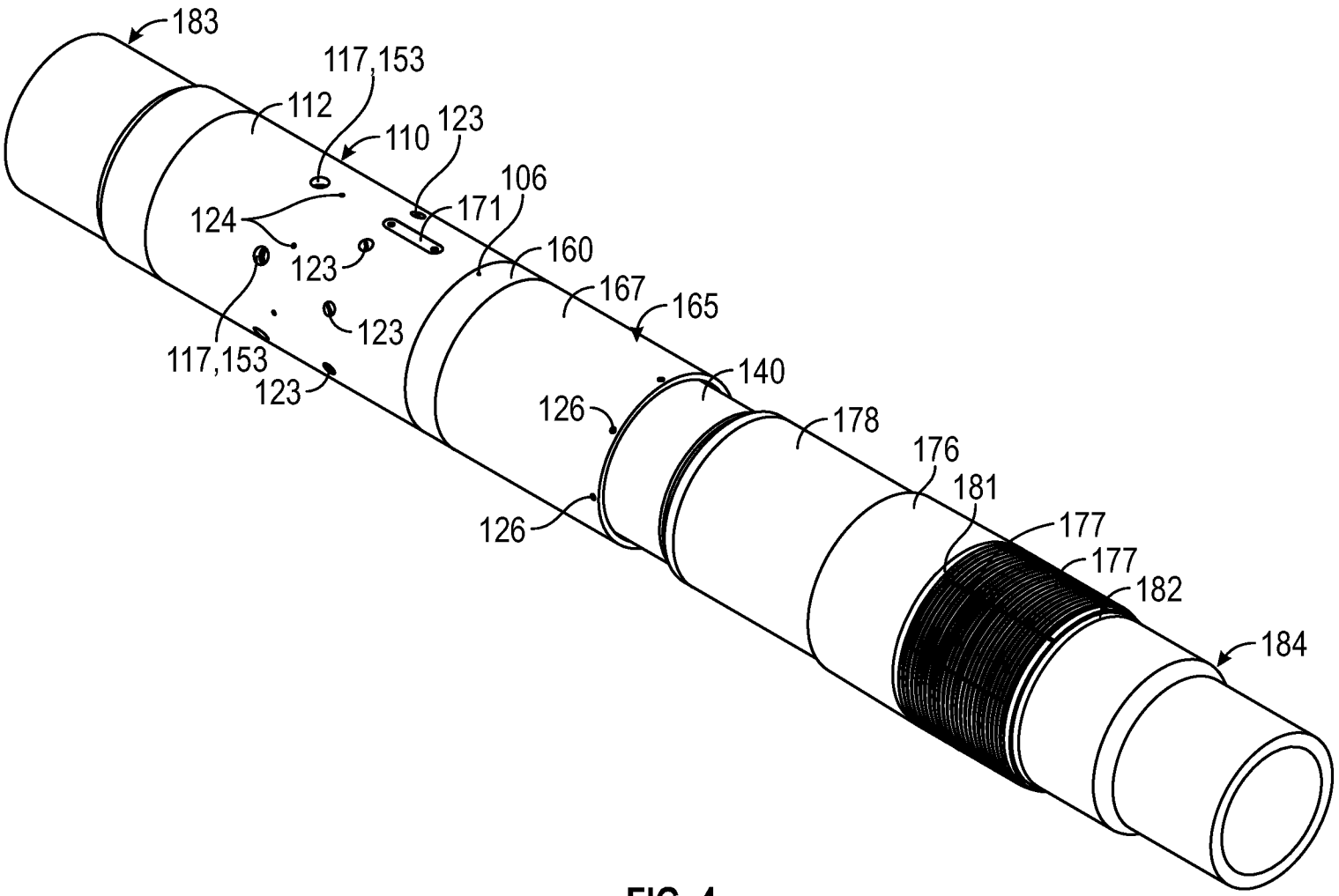
FIG. 4 is a schematic isometric view of the stage collar shown in FIG. 1 in a set configuration, according to one implementation.
Figure 5:
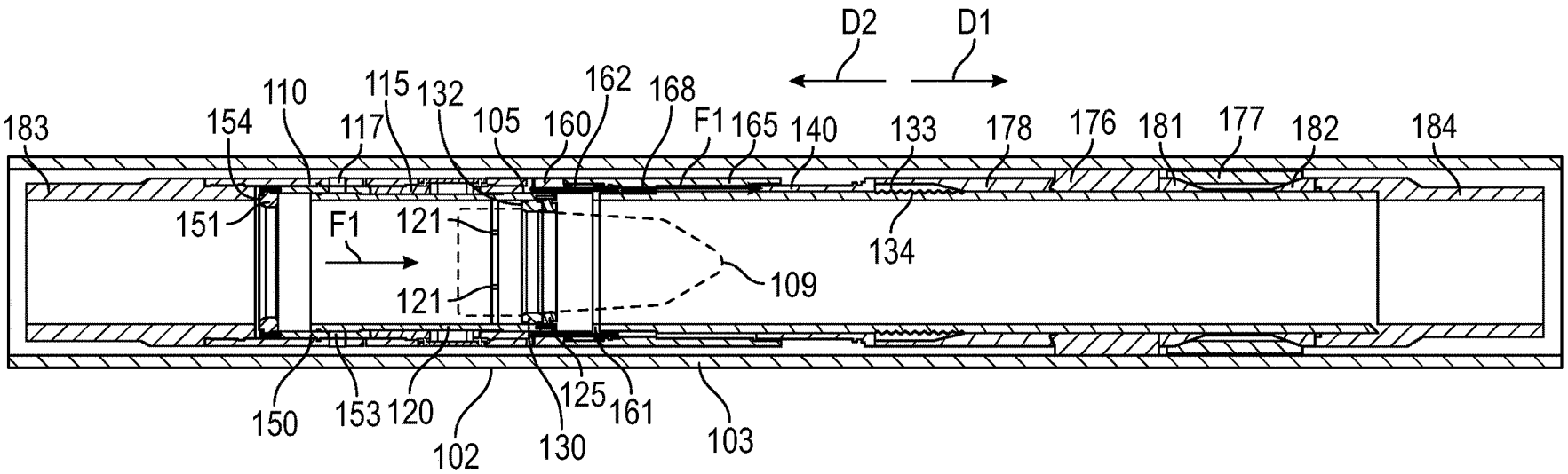
FIG. 5 is a schematic cross-sectional view of the stage collar shown in FIG. 4, according to one implementation.

FIG. 4 is a schematic isometric view of the stage collar 100 shown in FIG. 1 in a set configuration, according to one implementation. FIG. 5 is a schematic cross-sectional view of the stage collar 100 shown in FIG. 4, according to one implementation.

The pressurizing of the cone 109 at the first pressure shears the first set of shear fasteners 122 and translates the activation ring 130 to abut the activation ring 130 against the activation end ring 125 coupled to the activation sleeve 120. The translation of the activation ring 130 opens the first fluid openings 121 formed in the activation sleeve 120. The first fluid openings 121 are free of shear fasteners such that the operations fluid F1 flows through the first fluid openings 121 and into the flow gap 105. The operations fluid F1 flows through the flow gap 105 and into the first flow chamber 162 of the first chamber housing 160. The operations fluid F1 flows through the first flow chamber 162 and into the second flow chamber 168 of the second chamber housing 165. The operations fluid F1 flows through the second flow chamber 168 and against the setting piston 140. The operations fluid F1 is a hydraulic fluid, such as a drilling fluid (for example, a drilling mud).

Using the operations fluid F1, the setting piston 140 is pressurized at a second pressure through the first fluid openings 121. In one embodiment, which can be combined with other embodiments, the pressurizing of the setting piston 140 at the second pressure shears the fourth set of shear fasteners 126 to translate the setting piston 140. The translation of the setting piston 140 after the shearing of the fourth set of shear fasteners 126 sets the packer 176 and the slips 177 into the set configuration. The translation of the setting piston 140 abuts against and moves the inner wedge ring 133 and the gauge ring 178 to compress the packer 176 and move the first wedge ring 181. The setting into the set configuration includes the packer 176 and the slips 177 moving outwardly to engage the casing 103. The compression of the packer 176 moves the packer 176 outwardly and the movement of the first wedge ring 181 moves the slips 177 outwardly.

In one embodiment, which can be combined with other embodiments, the pressurizing of the setting piston 140 at the second pressure fully sets the packer 176 and the slips 177. In one embodiment, which can be combined with other embodiments, the pressurizing of the setting piston 140 at the second pressure at least partially sets the packer 176 and the slips 177. In one embodiment, which can be combined with other embodiments, the stage collar 100 has a gas seal rating of V0.

An interference interface 134 between the inner wedge ring 133 and the mandrel 175 allows movement of the inner wedge ring 133 and the gauge ring 178 in a first direction D1 and prevents movement of the inner wedge ring 133 and the gauge ring 178 in a second direction D2. The interference interface 134 facilitates retaining the stage collar 100 in the set configuration after the setting of the stage collar 100. In one embodiment, which can be combined with other embodiments, the interference interface 134 includes interfacing ratchet teeth (e.g., teeth threads) formed in each of the inner wedge ring 133 and the mandrel 175.

Using the activation ring 130, the activation end ring 125, the closing end ring 151, the first set of shear fasteners 122, the second set of shear fasteners 123, the third set of shear fasteners 124, and the fourth set of shear fasteners 126, the stage collar 100 facilitates simply and reliably: opening the first fluid openings 121, closing the first fluid openings 121, setting the stage collar 100, opening the second and third fluid openings 153, 117, and closing the second and third fluid openings 153, 117. The stage collar 100 facilitates doing so in a mature fashion without prematurely initiating the actions. As an example, the relatively small exterior surfaces 132, 154 (shown in FIG. 5) of the activation ring 130 and the closing end ring 151 facilitate reducing the probability that the stage collar 100 would be prematurely set, prematurely opened, and/or prematurely closed.

Figures 6, 8:
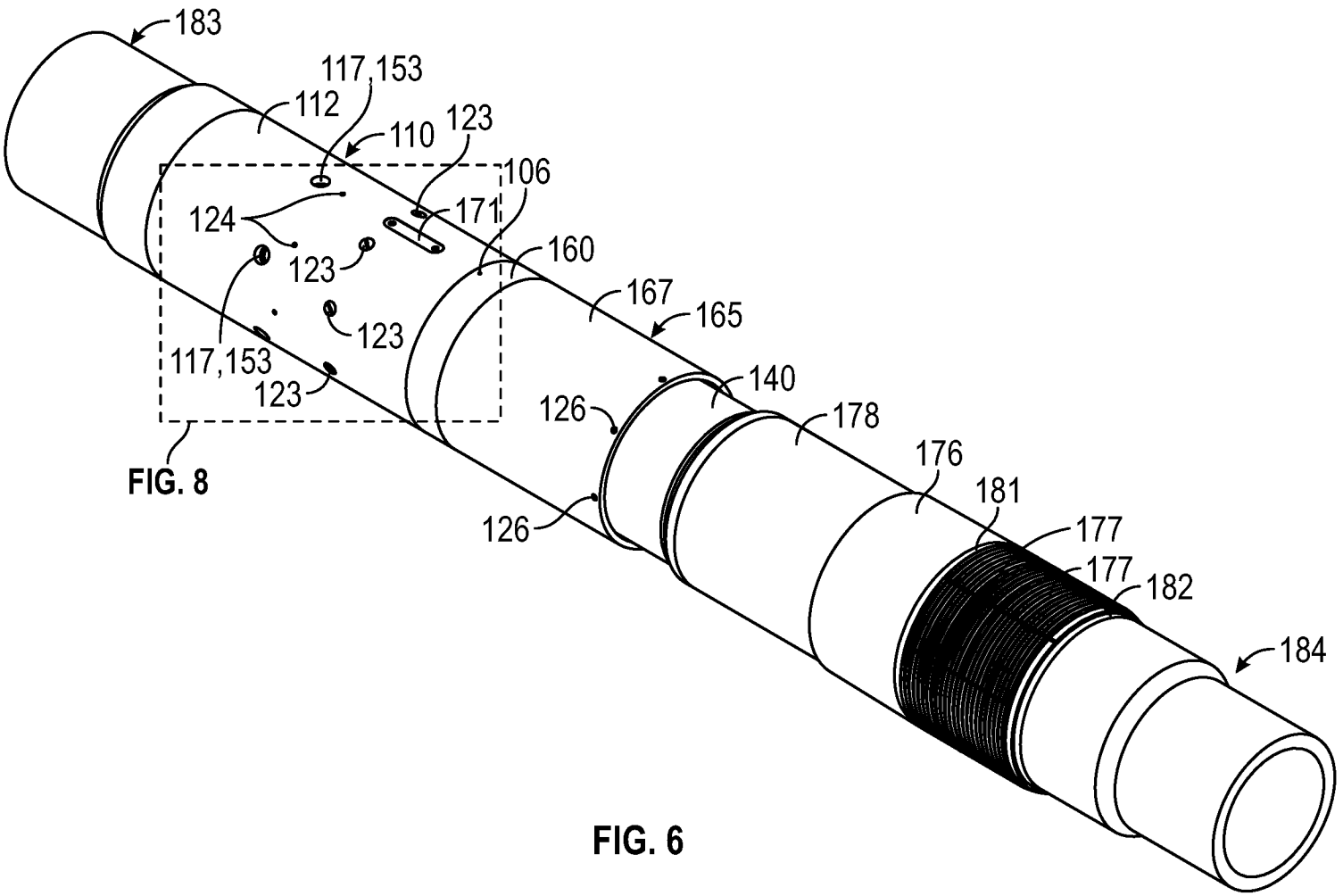
FIG. 6 is a schematic isometric view of the stage collar shown in FIG. 1 in an open configuration, according to one implementation.
FIG. 8 is an enlarged view of the schematic isometric view of the stage collar shown in FIG. 6, according to one implementation.
Figure 7:
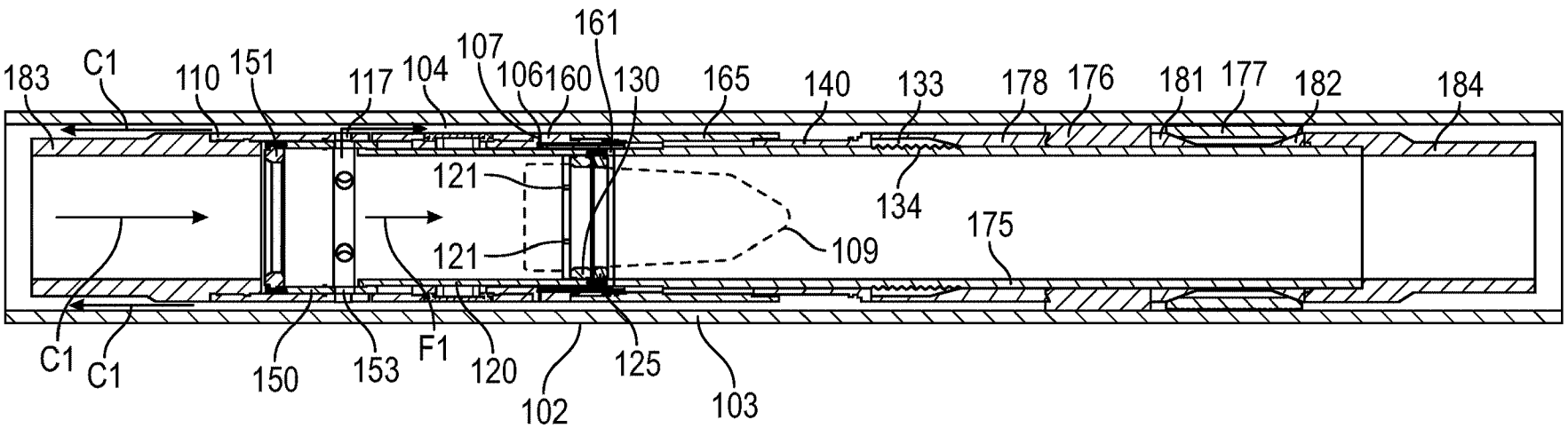
FIG. 7 is a schematic cross-sectional view of the stage collar shown in FIG. 6, according to one implementation.
Figure 8:
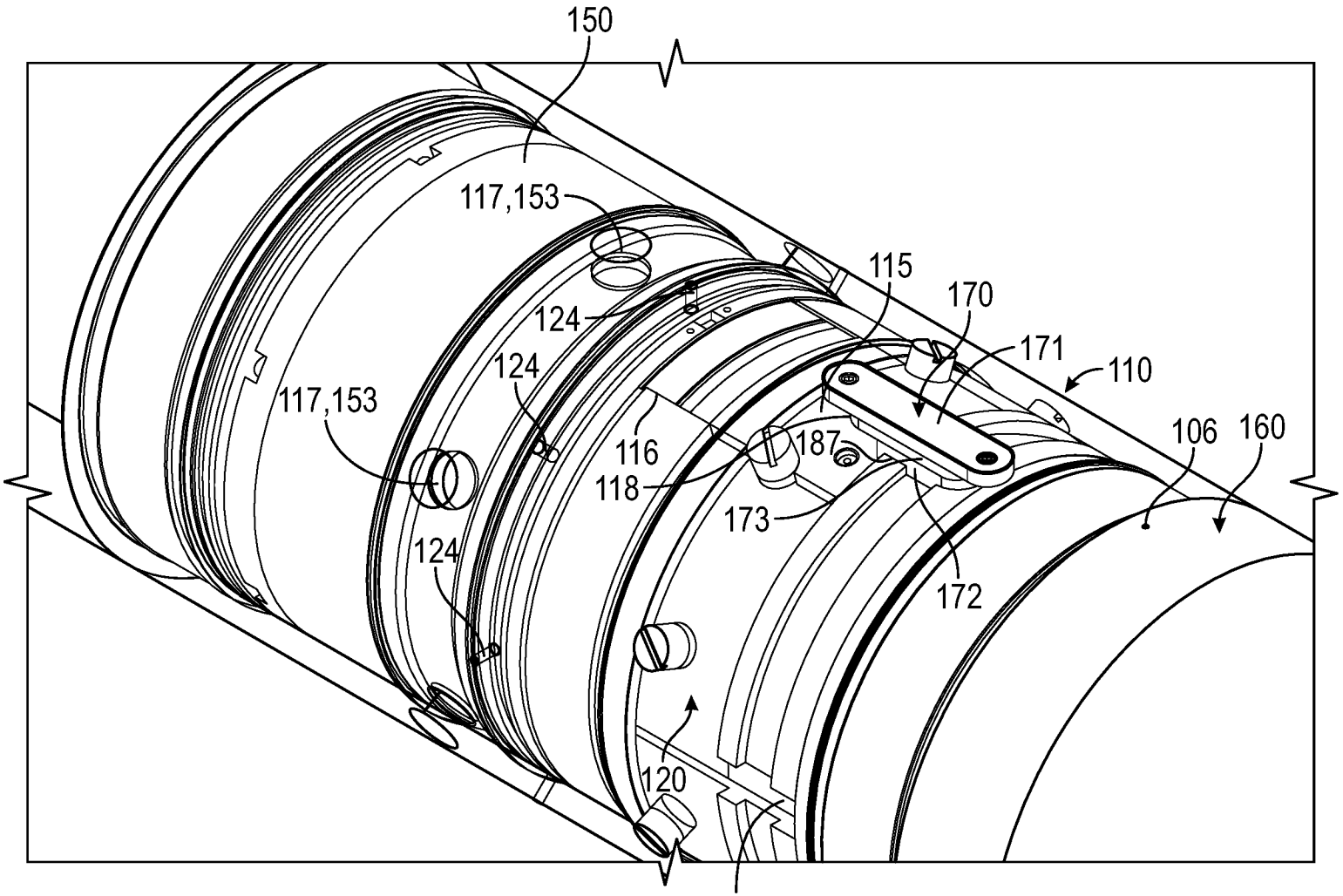

FIG. 6 is a schematic isometric view of the stage collar 100 shown in FIG. 1 in an open configuration, according to one implementation. FIG. 7 is a schematic cross-sectional view of the stage collar 100 shown in FIG. 6, according to one implementation. FIG. 8 is an enlarged view of the schematic isometric view of the stage collar 100 shown in FIG. 6, according to one implementation. The barrel 110 is shown as transparent (e.g., see-through) in FIG. 6.

Using the operations fluid F1, the cone 109 is pressurized at a third pressure. The pressurizing of the cone 109 at the third pressure shears the second set of shear fasteners 123 and translates the activation sleeve 120 to an open position shown in FIG. 7. The translation of the activation sleeve 120 to the open position includes opening second fluid openings 153 formed in the closing sleeve 150 and third fluid openings 117 formed in the barrel 110. The translation of the activation sleeve 120 includes closing the first fluid openings 121. The translation of the activation sleeve 120 to the open position includes abutting the activation sleeve 120 against the housing seat 161 of the first chamber housing 160.

In one embodiment, which can be combined with other embodiments, the operations fluid F1 flows outwardly into a casing annulus 104 through the second fluid openings 153 and the third fluid openings 117 prior to pumping of cementing fluid C1. The operations fluid F1 flows into the bypass line 106 from the casing annulus 104. The operations fluid F1 flows into the first flow chamber 162 through the check valve 107. The operations fluid F1 flows into the second flow chamber 168 and pressurizes the setting piston 140. In such an embodiment (such as an embodiment where the second pressure does not fully set the packer 176 and the slips 177), the operations fluid F1 at the third pressure can be used to pressurize the setting piston 140 through the bypass line 106 to set the packer 176 and the slips 177 to engage the casing 103. In such an embodiment, the check valve 107 is configured to open upon the casing annulus 104 being pressurized at the third pressure. Using the bypass line 106, the stage collar 100 facilitates redundant opportunities to set the stage collar 100, which facilitates simply and reliably setting the stage collar 100. The operations fluid F1 can be exhausted, and a cementing fluid C1 is pumped into the casing annulus 104 through the second fluid openings 153 and the third fluid openings 117 to cement a stage (e.g., a section) of the casing annulus 104 located uphole of the packer 176. The translation of the activation sleeve 120 translates the arcuate plates 115 at least partially out of the respective recesses 116. The translation of the arcuate plates 115 positions the key posts 172 at least partially into the respective plate slots 118.

In one or more embodiments, the translation of the activation sleeve 120 to the open position positions the activation sleeve 120 such that one or more seals between the activation sleeve 120 and the first chamber housing 160 are positioned between the first fluid openings 121 and the first flow chamber 162 to seal the first flow chamber 162 from the first fluid openings 121. The one or more seals can block the operations fluid F1 and/or the cementing fluid C1 from flowing into the first flow chamber 162 from the first fluid openings 121.

Figure 9:
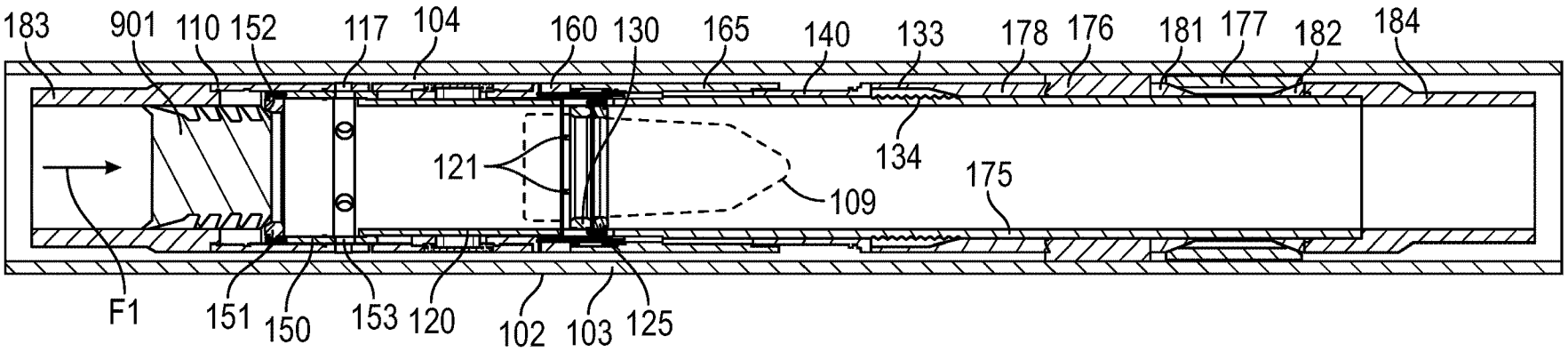
FIG. 9 is a schematic cross-sectional view of the stage collar shown in FIG. 6, according to one implementation.

FIG. 9 is a schematic cross-sectional view of the stage collar 100 shown in FIG. 6, according to one implementation. After the stage cementing is complete, a plug member 901, such as a dart or cone, is pumped downhole to position the plug member 901 against the closing seat 152 of the closing end ring 151 coupled to the closing sleeve 150. The plug member 901 is pressurized using the operations fluid F1.

Figure 10:
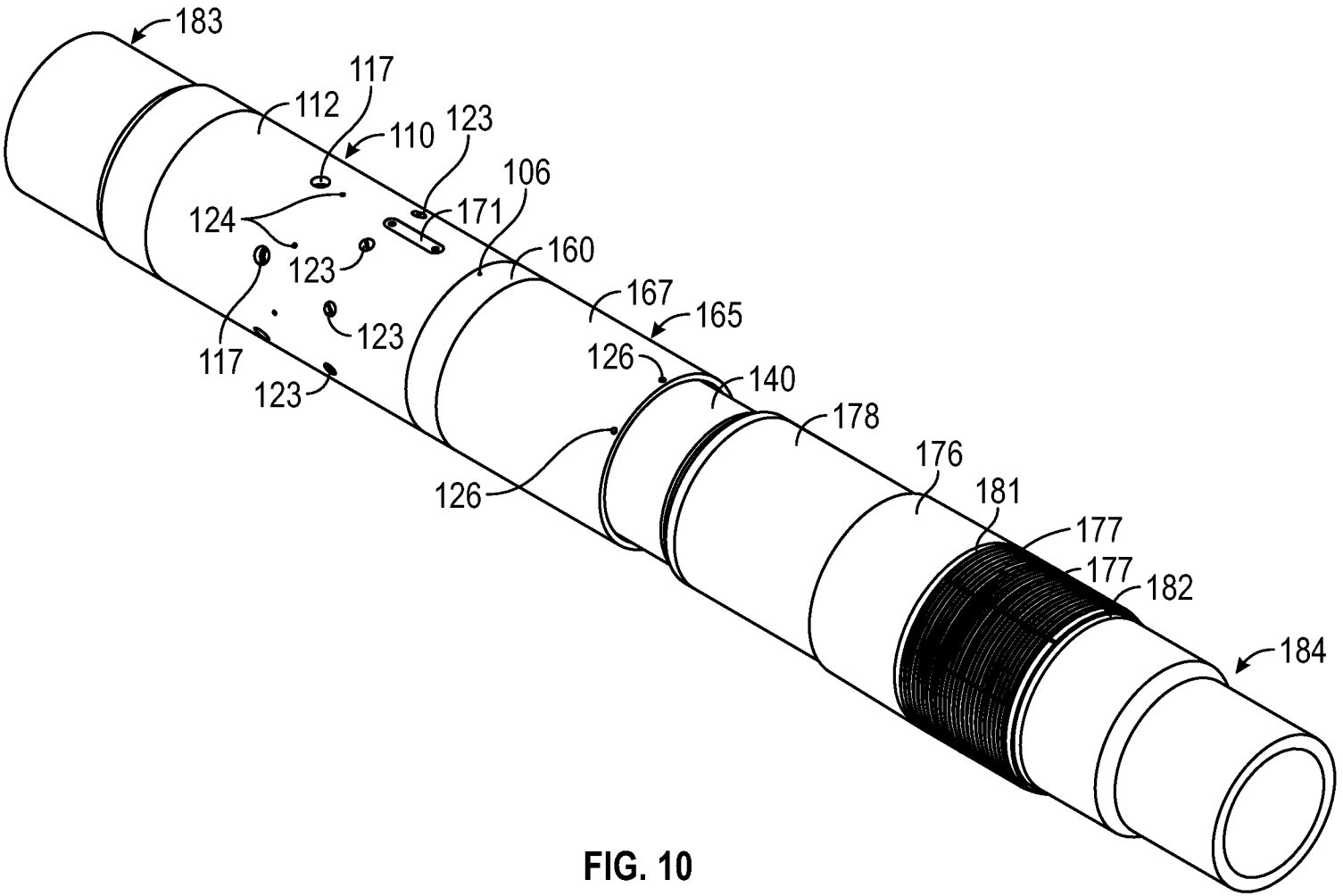
FIG. 10 is a schematic isometric view of the stage collar shown in FIG. 1 in a closed configuration, according to one implementation.
Figure 11:
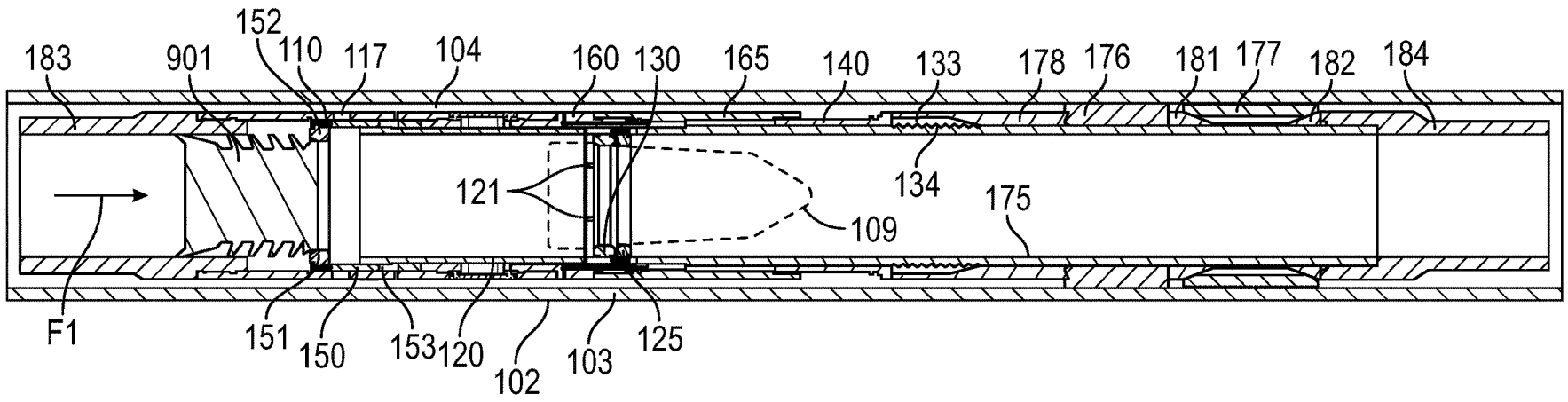
FIG. 11 is a schematic cross-sectional view of the stage collar shown in FIG. 10, according to one implementation.

FIG. 10 is a schematic isometric view of the stage collar 100 shown in FIG. 1 in a closed configuration, according to one implementation. FIG. 11 is a schematic cross-sectional view of the stage collar 100 shown in FIG. 10, according to one implementation. The pressurizing of the plug member 901 using the operations fluid F1 shears the third set of fasteners 124 and translates the closing sleeve 150 to the closed position. In one embodiment, which can be combined with other embodiments, the plug member 901 is pressurized at a fourth pressure to shear the third set of fasteners 124. The translation of the closing sleeve 150 to the closed position includes closing the second fluid openings 153 formed in the closing sleeve 150 and closing the third fluid openings 117 formed in the barrel 110. In one embodiment, which can be combined with other embodiments, the second pressure is higher than the first pressure, and the third pressure is higher than the second pressure. In one embodiment, which can be combined with other embodiments, the fourth pressure is higher than the third pressure.

Portions of the stage collar 100 can be drilled out. In one embodiment, which can be combined with other embodiments, the stage collar 100 is drilled out for further downhole operations by drilling out at least a portion of the closing end ring 151, drilling out the activation ring 130, and drilling out the activation end ring 125. Aspects of the stage collar 100 (such as the closing end ring 151, the activation ring 130, and the activation end ring 125) facilitate drilling out less material and less components of the stage collar 100 relative to other stage collars to facilitate a simple, cost-effective, and reliable drill out of the stage collar.

The activation sleeve 120 is formed of steel, such as carbon steel or stainless steel, to facilitate reduced costs and simple manufacturing of the activation sleeve 120. Each of the closing end ring 151, the activation ring 130, and the activation end ring 125 is formed of a drillable material.

Figure 12:
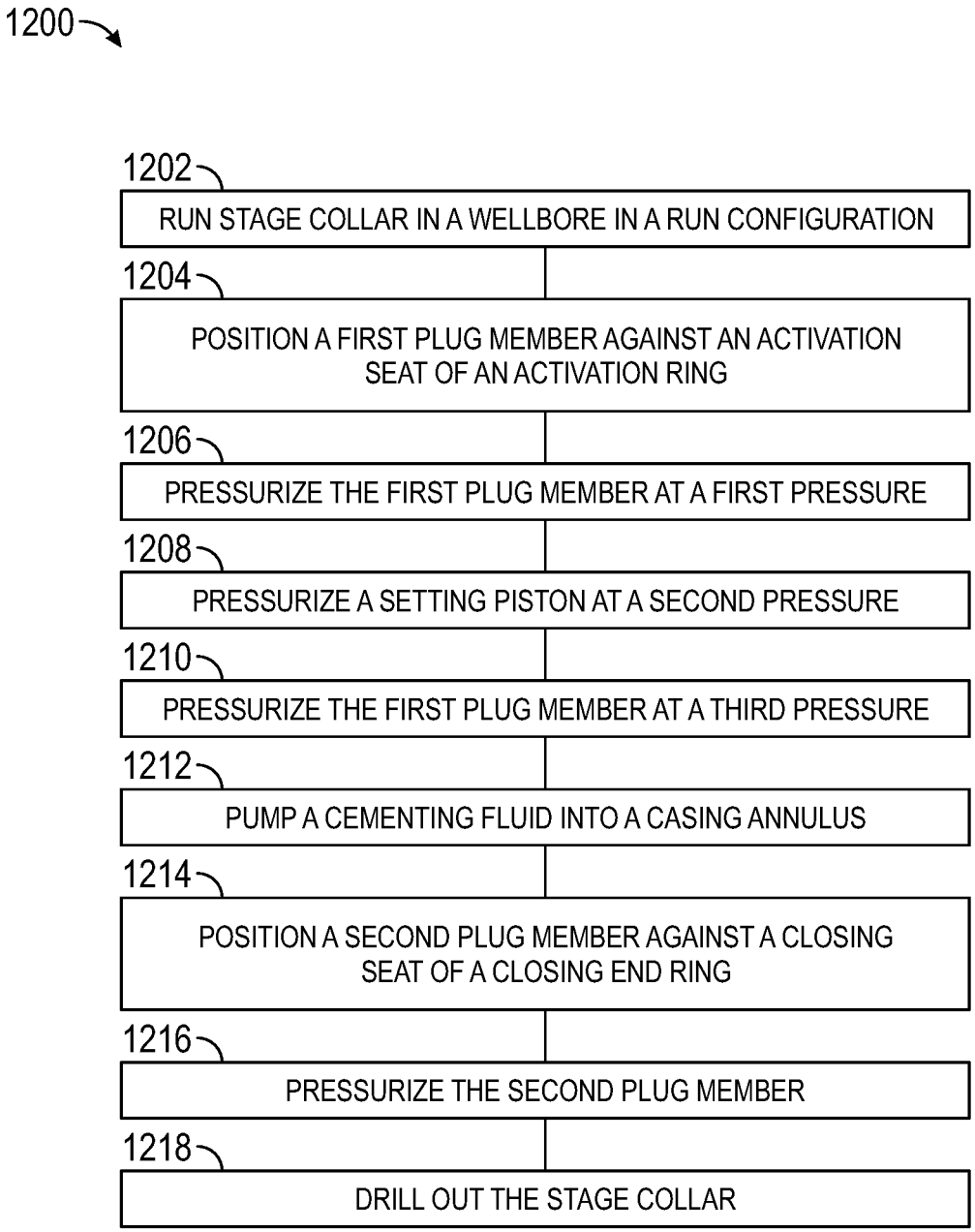
FIG. 12 is a schematic block diagram view of a method of operating a stage collar, according to one implementation.

FIG. 12 is a schematic block diagram view of a method 1200 of operating a stage collar, according to one implementation.

Operation 1202 includes running the stage collar in a wellbore in a run configuration. One or more sets of shear fasteners of the stage collar can be adjusted (such as by turning and/or replacing the shear fasteners) to adjust the shear strength(s) at which the one or more sets of shear fasteners shear prior to running the stage collar. The one or more sets of shear fasteners can be adjusted in the field, such as at a wellsite.

Operation 1204 includes positioning a plug member, such as a cone, against an activation seat of an activation ring. The activation ring is coupled to an activation sleeve using a first set of shear fasteners. The activation sleeve is disposed at least partially in a barrel and coupled to the barrel using a second set of shear fasteners.

Operation 1206 includes pressurizing the cone at a first pressure to shear the first set of shear fasteners and translate the activation ring to abut the activation ring against an activation end ring coupled to the activation sleeve. The translation of the activation ring includes opening first fluid openings formed in the activation sleeve.

Operation 1208 includes pressurizing a setting piston at a second pressure through the first fluid openings.

Operation 1210 includes pressurizing the cone at a third pressure to shear the second set of shear fasteners and translate the activation sleeve to an open position. The translation of the activation sleeve to the open position includes opening second fluid openings formed in a closing sleeve disposed at least partially in the barrel and coupled to the barrel using a third set of shear fasteners.

Operation 1212 includes pumping a cementing fluid through the second fluid openings and into a casing annulus.

Operation 1214 includes positioning another plug member against a closing seat of a closing end ring coupled to the closing sleeve.

Operation 1216 includes pressurizing the plug member to shear the third set of fasteners and translate the closing sleeve to a closed position. The translation of the closing sleeve to the closed position includes closing the second fluid openings formed in the closing sleeve.

Operation 1218 includes drilling out the stage collar. The drilling out includes drilling out: at least a portion of the closing end ring, at least a portion of the activation ring, and at least a portion of the activation end ring. In one embodiment, which can be combined with other embodiments, a portion of the closing end ring is drilled out, the activation ring is drilled out, and the activation end ring is drilled out.

Figures 13, 14:
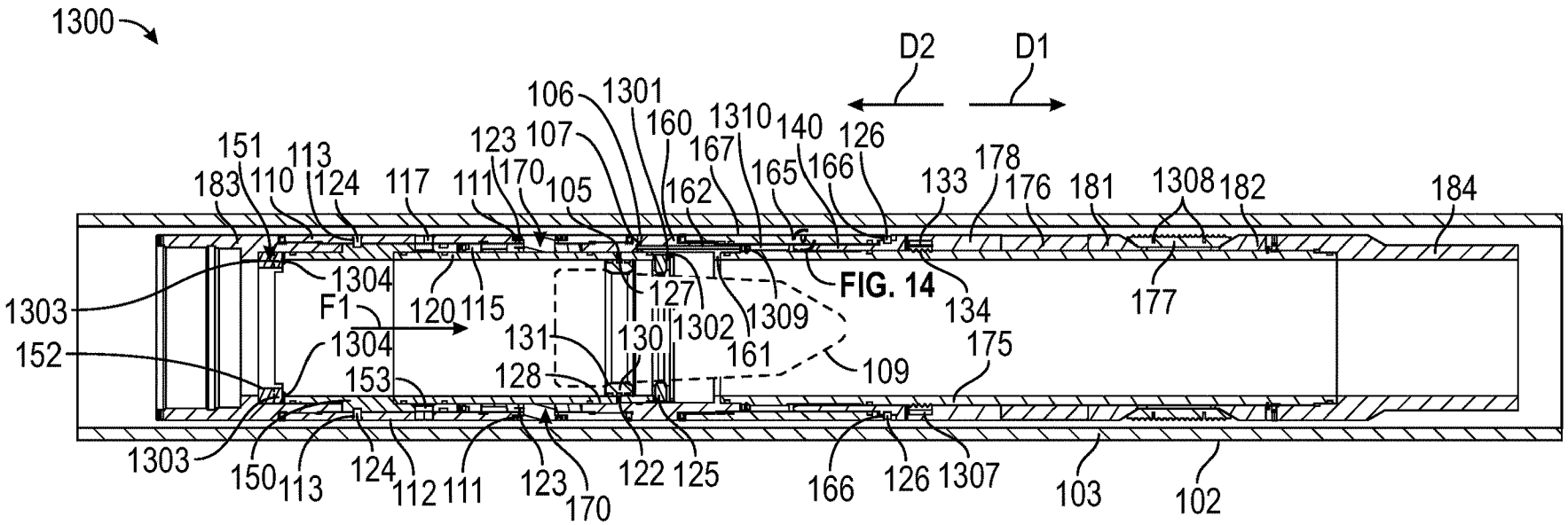
FIG. 13 is a schematic isometric view of a stage collar for cementing operations in a run configuration, according to one implementation.
FIG. 14 is an enlarged view of the stage collar shown in FIG. 13, according to one implementation.
Figure 14:
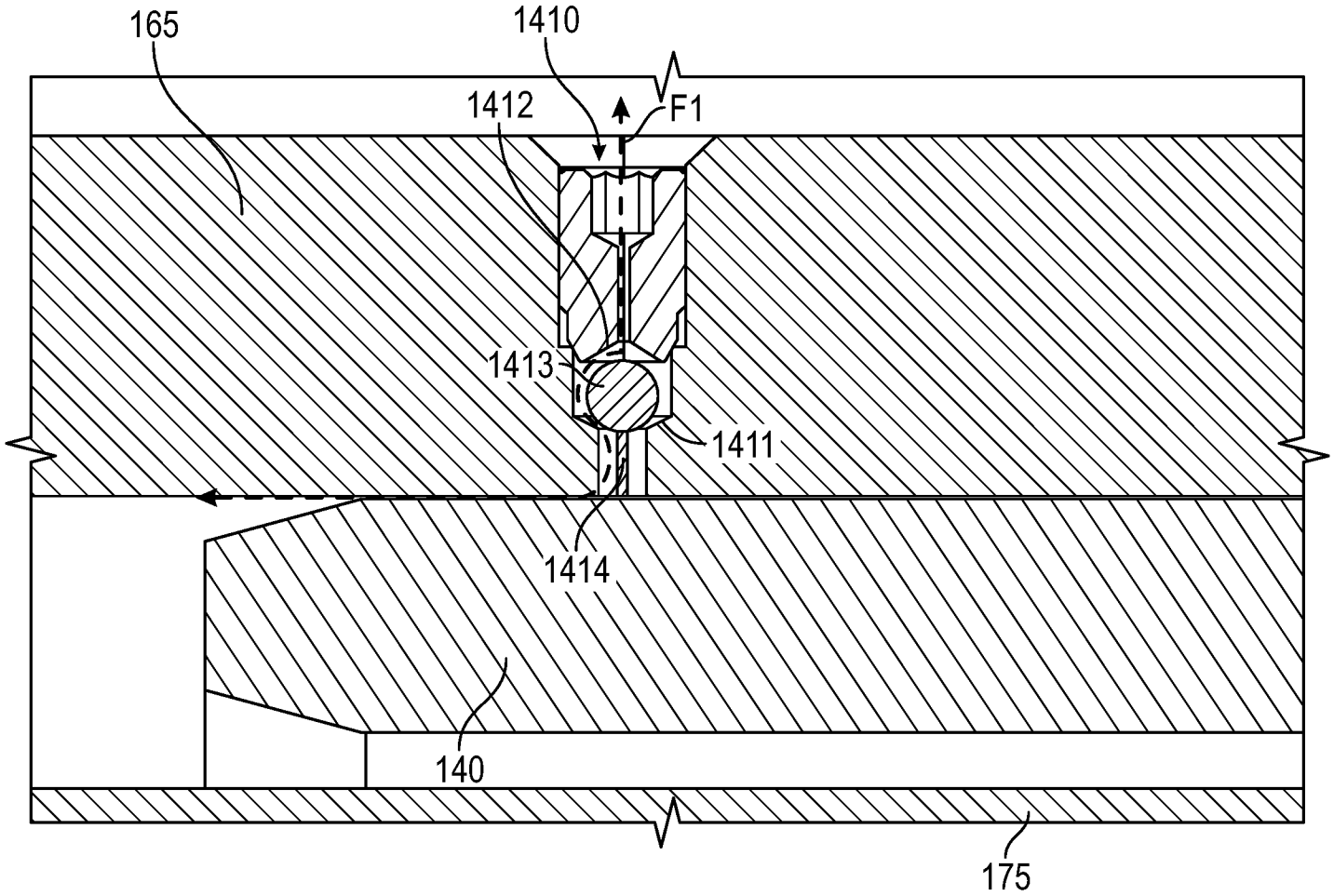

FIG. 13 is a schematic isometric view of a stage collar 1300 for cementing operations in a run configuration, according to one implementation. The stage collar 1300 is similar to the stage collar 100, and includes one or more aspects, features, components, operations, and/or properties thereof.

In the implementation shown in FIG. 2, the activation end ring 125 is coupled to the activation sleeve 120 using a plurality of fasteners (such as screws or bolts). In the implementation shown in FIG. 13, the activation end ring 125 is coupled to the activation sleeve 120 using one or more snap rings 1301 positioned between the activation end ring 125 and a shoulder 1302 of the activation sleeve.

In the implementation shown in FIG. 2, the closing end ring 151 is coupled to the closing sleeve 150 using a plurality of fasteners (such as screws or bolts). In the implementation shown in FIG. 13, the closing end ring 151 can be pushed to engage the closing sleeve 150. An anti-rotation interface can be formed between the closing end ring 151 and the closing sleeve 150. One or more lug portions 1303 of the closing end ring 151 abut against one or more recessed shoulders 1304 of the closing sleeve 150 to limit rotation of the closing end ring 151 and the closing sleeve 150 relative to each other. The limited rotation facilitates drilling out the closing end ring 151 and the closing sleeve 150 after the stage collar 1300 is used.

A second anti-rotation interface can be formed between the activation end ring 125 and the activation ring 130. For example, opposing and interlocking shoulders of the activation end ring 125 and the activation ring 130 can abut against each other (thereby limiting rotation of the activation ring 130 and the activation end ring 125 relative to each other) when the activation ring 130 is moved to abut against the activation end ring 125. The limited rotation facilitates drilling out the activation ring 130 and the activation end ring 125 after the stage collar 1300 is used.

In the implementation shown in FIG. 13, the 105, the 162, and the 140 are continuously exposed to a bore pressure (e.g., the pressure of the operations fluid F1) after the 130 moves to the set configuration. For example, the 105, the 162, and the 140 are continuously exposed to the bore pressure during the set configuration, the open configuration, and the closed configuration. The continuous exposure facilitates preventing build-up of hydraulic lock and facilitates overpressure of the stage collar 1300.

In the implementation shown in FIG. 13, a planar surface of the inner wedge ring 133 abuts against a planar surface of the gauge ring 178. A space 1307 is disposed between the inner wedge ring 133 and a leg of the gauge ring 178.

In the implementation shown in FIG. 13 the slips 177 each have spaces 1308 (e.g., grooves) formed therein. Guide pins can be disposed in the spaces 1308. Composite spacers (e.g., composite C-rings) can be disposed in the spaces 1308. Components such as wires, rings, and/or other components can be disposed in the spaces 1308 until the stage collar 1300 is set to hold the slips 177 in place, and during setting the components can shear, break, or disassemble while the slips 177 move outward. The stage collar 1300 includes one or more snap rings 1309 and a gap 1310 between the first flow chamber 162 and the setting piston 140.

FIG. 14 is an enlarged view of the stage collar 1300 shown in FIG. 13, according to one implementation. The stage collar 1300 includes a pressure balance assembly 1410. The pressure balance assembly 1410 includes two seats 1411, 1412 and a ball 1413. The ball 1413 is supported on a pin 1414. Before the setting piston 140 moves to the set configuration, the setting piston 140 is under the pin 1414, which supports the ball 1413 in a middle position such that operations fluid F1 can flow either way around the ball 1413. As the setting piston 140 moves to the set configuration, the setting piston 140 moves out from under the pin 1414, allowing the pin to drop such that the ball 1413 can free float. The ball 1413 can then be used as a two-way check valve. When fluid flows into the stage collar 1300, the ball 1413 seats against the first seat 1411 and blocks the flow. When fluid flows out of the stage collar 1300, the ball 1413 seats against the second seat 1412 and blocks the flow. The ball 1413 and pin 1414 can be separate components or can be integrated together. The pressure balance assembly 1410 facilitates reduced damage (e.g., crushing) of the stage collar 1300 as the stage collar 1300 is lowered to increasing depths before the stage collar 1300 is set into the set configuration.

Benefits of the present disclosure include redundant opportunities to set stage collars, tight gas seal ratings for stage collars, simply and reliably setting stage collars in a mature fashion, reliable operation (such as for stage cementing operations), reduced operational delays, and reduced costs. Benefits of the present disclosure also include drilling out less material and less components of the stage collar relative to other stage collars to facilitate a simple, cost-effective, and reliable drill out of the stage collar 100.

Using aspects described herein, it is believed that there is a 50% less probability of prematurely setting the stage collar 100 relative to other stage collars.

It is contemplated that one or more of the aspects disclosed herein may be combined. Moreover, it is contemplated that one or more of these aspects may include some or all of the aforementioned benefits.

The present disclosure contemplates that one or more aspects, features, components, operations, and/or properties of the stage collar 100, the stage collar 1300, the pressure balance assembly 1410, and/or the method 1200 may be combined. As an example, it is contemplated that one or more operations described in relation to the stage collar 100 shown in FIGS. 1-11 can be combined with the operations of the method 1200.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A stage collar for stage cementing operations, comprising:
- a barrel;
- an activation sleeve disposed at least partially in the barrel, the activation sleeve comprising first fluid openings;
- an activation ring comprising an activation seat;
- a first set of shear fasteners coupling the activation ring to the activation sleeve;
- a second set of shear fasteners coupling the activation sleeve to the barrel;
- a setting piston;
- a closing sleeve disposed at least partially in the barrel, the closing sleeve comprising second fluid openings; and
- a third set of shear fasteners coupling the closing sleeve to the barrel.

2. The stage collar of claim 1, further comprising:
- an activation end ring coupled to the activation sleeve; and
- a closing end ring coupled to the closing sleeve, the closing end ring comprising a closing seat.

3. The stage collar of claim 1, further comprising:
- a first chamber housing disposed at least partially about the activation sleeve and coupled to the barrel; and
- a second chamber housing coupled to the first chamber housing.

4. The stage collar of claim 3, wherein the first chamber housing comprises a housing seat extending inwardly.

5. The stage collar of claim 3, wherein the second chamber housing is coupled to the setting piston using a fourth set of shear fasteners.

6. The stage collar of claim 5, wherein:
- the first set of shear fasteners are disposed in a first set of fastener openings extending into an outer surface of the activation sleeve;
- the second set of shear fasteners are disposed in a second set of fastener openings extending into an outer surface of the barrel; and
- the third set of shear fasteners are disposed in a third set of fastener openings extending into the outer surface of the barrel.

7. The stage collar of claim 6, wherein the fourth set of shear fasteners are disposed in a fourth set of fastener openings extending into an outer surface of the second chamber housing.

8. The stage collar of claim 3, further comprising:
- a first flow chamber formed in the first chamber housing;
- a second flow camber formed in the second chamber housing; and
- a flow gap between the activation sleeve and the first chamber housing.

9. The stage collar of claim 8, further comprising:
- a bypass line formed in the first chamber housing and in fluid communication with the first flow chamber; and
- a check valve positioned along the bypass line.

10. The stage collar of claim 1, further comprising an arcuate plate coupled to the activation sleeve, the arcuate plate disposed at least partially in a recess formed in the activation sleeve.

11. The stage collar of claim 10, further comprising a key, the key comprising:

a key plate coupled to the barrel; and a key post extending relative to the key plate and into a slot formed in the barrel.

12. The stage collar of claim 11, wherein the arcuate plate comprises a plate slot aligned with a slot formed in the activation sleeve.

13. The stage collar of claim 3, further comprising:

a mandrel;

a packer disposed outwardly of the mandrel; and a plurality of slips disposed outwardly of the mandrel.

14. The stage collar of claim 13, further comprising:

a gauge ring disposed about the mandrel, wherein the second chamber housing is coupled to the mandrel, and the barrel is coupled to the first chamber housing;

a first wedge ring; and a second wedge ring, wherein the plurality of slips are disposed between the first wedge ring and the second wedge ring, and the packer is disposed between the gauge ring and the first wedge ring.

15. A method of operating a stage collar, comprising:

running the stage collar in a wellbore in a run configuration;

positioning a first plug member against an activation seat of an activation ring, the activation ring coupled to an activation sleeve using a first set of shear fasteners, and the activation sleeve disposed at least partially in a barrel and coupled to the barrel using a second set of shear fasteners;

pressurizing the first plug member at a first pressure to shear the first set of shear fasteners and translate the activation ring to abut the activation ring against an activation end ring coupled to the activation sleeve;

opening first fluid openings formed in the activation sleeve;

pressurizing a setting piston at a second pressure through the first fluid openings;

pressurizing the first plug member at a third pressure to shear the second set of shear fasteners and translate the activation sleeve to an open position;

opening second fluid openings formed in a closing sleeve disposed at least partially in the barrel and coupled to the barrel using a third set of shear fasteners;

pumping a cementing fluid through the second fluid openings and into a casing annulus;

positioning a second plug member against a closing seat of a closing end ring coupled to the closing sleeve;

pressurizing the second plug member to shear the third set of fasteners and translate the closing sleeve to a closed position; and closing the second fluid openings formed in the closing sleeve.

16. The method of claim 15, further comprising, prior to the running of the stage collar in the wellbore, adjusting one or more of the second set of shear fasteners or the third set of shear fasteners from an outer side of the stage collar.

17. The method of claim 15, wherein the pressurizing of the setting piston at the second pressure through the first fluid openings translates the setting piston, and the translation of the setting piston comprises:

moving a packer and a plurality of slips outward to engage a casing of the wellbore.

18. The method of claim 15, wherein the second pressure is higher than the first pressure, and the third pressure is higher than the second pressure.

19. The method of claim 15, wherein the setting piston is pressurized at the second pressure further through:

a first chamber housing disposed at least partially about the activation sleeve; and a second chamber housing interfacing with the first chamber housing.

20. The method of claim 19, wherein the translation of the activation sleeve to the open position further comprises abutting the activation sleeve against a housing seat of the first chamber housing.

21. The method of claim 19, wherein the second chamber housing is coupled to the setting piston using a fourth set of shear fasteners, and the pressurizing of the setting piston at the second pressure shears the fourth set of shear fasteners to translate the setting piston.

22. The method of claim 19, further comprising, prior to the pumping of the cementing fluid, pressurizing the setting piston through the second fluid openings of the closing sleeve, the casing annulus, and a bypass line of the first chamber housing to translate the setting piston, wherein a check valve is positioned along the bypass line, and the translation of the setting piston comprises:

moving a packer and a plurality of slips outward to engage a casing of the wellbore.

* * * * *